US009212031B2

(12) United States Patent
Schneider et al.

(10) Patent No.: US 9,212,031 B2
(45) Date of Patent: Dec. 15, 2015

(54) CRANE CONTROL APPARATUS

(75) Inventors: Klaus Schneider, Hergatz (DE); Oliver Sawodny, Stuttgart (DE); Conrad Sagert, Filderstadt (DE); Ulf Schaper, Stuttgart (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 326 days.

(21) Appl. No.: 13/595,239

(22) Filed: Aug. 27, 2012

(65) Prior Publication Data

US 2013/0161279 A1 Jun. 27, 2013

(30) Foreign Application Priority Data

Aug. 26, 2011 (EP) ..... 11006987

(51) Int. Cl.

| | |
|---|---|
| ***G06F 7/70*** | (2006.01) |
| ***B66C 13/06*** | (2006.01) |
| ***B66C 13/00*** | (2006.01) |
| ***B66C 13/08*** | (2006.01) |
| *F02D 41/02* | (2006.01) |
| *F02D 41/14* | (2006.01) |

(52) U.S. Cl.

CPC ..... *B66C 13/06* (2013.01); *B66C 13/00* (2013.01); *B66C 13/085* (2013.01); *F02D 41/021* (2013.01); *F02D 2041/1417* (2013.01)

(58) Field of Classification Search

CPC .... B66C 13/063; B66C 13/22; B66C 19/002; B66C 13/40; B66C 13/46; B66C 23/00; B66C 23/52; B66C 13/06; B66C 13/00

USPC ..... 701/34.4, 50; 212/273, 232, 272, 147, 212/132

See application file for complete search history.

(56) References Cited

U.S. PATENT DOCUMENTS

| | | | | |
|---|---|---|---|---|
| 3,517,830 | A * | 6/1970 | Virkkala | 212/275 |
| 5,806,695 | A * | 9/1998 | Hytonen | 212/270 |
| 5,961,563 | A * | 10/1999 | Overton | 701/50 |
| 8,267,264 | B2 * | 9/2012 | Bryfors et al. | 212/274 |
| 8,326,784 | B2 * | 12/2012 | Meers et al. | 706/45 |
| 2004/0026349 | A1 * | 2/2004 | Colgate et al. | 212/284 |
| 2008/0017601 | A1 * | 1/2008 | Neupert et al. | 212/270 |
| 2009/0008351 | A1 * | 1/2009 | Schneider et al. | 212/272 |
| 2010/0230370 | A1 * | 9/2010 | Schneider et al. | 212/276 |
| 2011/0066394 | A1 * | 3/2011 | Schneider et al. | 702/101 |
| 2011/0146556 | A1 * | 6/2011 | Yuan | 114/121 |
| 2011/0218714 | A1 * | 9/2011 | Stantchev et al. | 701/50 |
| 2013/0032561 | A1 * | 2/2013 | Singhose et al. | 212/273 |

FOREIGN PATENT DOCUMENTS

| | | |
|---|---|---|
| DE | 10064182 | 5/2002 |
| FR | 2939783 | 6/2010 |

* cited by examiner

*Primary Examiner* — Tuan C. To
*Assistant Examiner* — Shardul Patel
(74) *Attorney, Agent, or Firm* — Dilworth & Barrese, LLP

(57) ABSTRACT

The present invention relates to a crane control apparatus for a crane where a load is suspended on a crane cable from a cable suspension point of the crane, comprising an observer for estimating at least the position and/or velocity of the load from at least one sensor input of a first sensor by using a physical model of the load suspended on the crane cable, whereby the physical model of the observer uses the load position and/or the load velocity as a state variable.

17 Claims, 9 Drawing Sheets

CRANE CONTROL APPARATUS

BACKGROUND OF THE INVENTION

The present invention is directed to a crane control apparatus for a crane where a load is suspended on a crane cable from a cable suspension point of the crane.

For the control of the crane, exact information on the position and/or the velocity of the load is of great importance. However, this position and/or load velocity of the load can usually not be measured directly, but has to be calculated from measurements that do not directly describe the load position and/or load velocity but related quantities.

For example, in many crane control apparatuses, the cable angle and/or the cable angle velocity is measured by a sensor, from which the load position and/or velocity is calculated. For example, a gyroscope located on a cable follower can be used for measuring cable angle velocity.

However, because of measurement noise and other uncertainties, a purely kinematic model for calculating the position and/or velocity of the load from the sensor input of the sensor is often insufficient for providing the exactness required by usual crane control applications.

Therefore, state observers have been used for estimating at least the position and/or velocity of the load from the sensor input by using a physical model of the load suspended on the crane cable. An example of such a system is shown in DE 100 641 82.

Such observers usually use the cable angle and/or the cable angle velocity as state variables, as this simplifies calculations of the expected measurement signals of the sensors, which relate to the same quantities. The load position and/or velocity is then derived from these state variables.

SUMMARY OF THE INVENTION

The present invention is directed to improving such a crane control apparatus comprising an observer for estimating at least the position and/or velocity of the load.

This object is solved by a crane control apparatus according to the features herein.

Preferred embodiments of the present invention are the subject matter herein.

The present invention shows a crane control apparatus for a crane where a load is suspended on a crane cable from a cable suspension point of the crane. The crane control apparatus comprises an observer for estimating at least the position and/or velocity of the load from at least one sensor input of a first sensor by using a physical model of the load suspended on the crane cable. The crane control apparatus of the present invention is characterized in that the physical model of the observer uses the load position and/or the load velocity as a state variable. The inventors of the present invention have realized that this choice of the state vector has a strong impact on the input values necessary for the observer.

In particular, the inventors of the present invention have realized that if the cable angle and its derivative are used as state variables, the dynamics of this state vector will directly depend on the acceleration of the cable suspension point. In contrast, if the load position and/or the load velocity are used as state variables, as in the observer of the present invention, the dynamics of this state will depend, at least in a first order approximation, only on the position of the cable suspension point and not on the acceleration of the cable suspension point.

This phenomenon can best be understood when one looks at the impact of a movement of the cable suspension point on the cable angle on one hand, and the load position on the other hand: It is apparent that a movement of the cable suspension point will have an immediate effect on the cable angle, while the load will, because of its inertia, at first remain at its position. Therefore, the observer of the present invention, where the load position and/or the load velocity are used as state variables, will depend less or not at all on the acceleration of the cable suspension point.

In industrial implementations, the suspension point position is usually measurable with high accuracy. However, the suspension point acceleration is not that easy to quantify. Differentiation methods get quite involved when it comes to differentiating twice. Actuator models which reconstruct the acceleration from valve currents and friction models also carry large uncertainties. The present invention therefore provides a better observer design, because the observer depends less or not at all on this value.

In a preferred embodiment, the present invention provides a crane control apparatus for controlling the position and/or velocity of the load suspended on the rope by using feedback control, where the position and/or the velocity of the load is determined by the observer and used as feedback. The present invention uses an observer design where an inertial coordinate system is used for modelling the load swing. This eliminates the need of measuring the boom tip acceleration and therefore improves the observer performance during acceleration phases.

In a preferred embodiment of the present invention, the observer uses the position of the cable suspension point as an input. In particular, in the present invention, the physical model of the observer describes the dynamics of the load position and/or the load velocity in dependency on the position of the cable suspension point using a model of the pendulum dynamics of the load suspended on the cable.

The position of the cable suspension point used as an input for the observer of the present invention can be calculated from at least one sensor input of a second sensor. For example, this sensor can measure a luffing and/or a slewing angle of the boom of the crane. Alternatively or in addition, control signals for the actuators for controlling the position of the cable suspension point can be used for determining the position of the cable suspension point.

The physical model used in the observer can be a linearized model of the load suspended on the rope, e.g. a linear pendulum model. However, in a preferred embodiment the physical model is a non-linear model.

The observer of the present invention may use the velocity of the cable suspension point as an input. In particular, this velocity of the cable suspension point might be necessary as an input if a non-linear model is used and/or if the cable velocity is measured by the first sensor. The velocity of the cable suspension point can for example be numerically calculated from the measured position of the cable suspension point or from actuator models which reconstruct the velocity from valve currents.

However, in a preferred embodiment, the observer of the present invention is independent of the acceleration of the cable suspension point. Thereby, the large uncertainties involved in obtaining this acceleration can be avoided.

This is possible in the present invention because the acceleration of the cable suspension point only plays a minor role for the state variables used for the observer. It has to be noted that when an exact non-linear model is used, the acceleration of the cable suspension point plays a role at higher orders of the dynamics of the load position and/or the load velocity. However, in the present invention, the acceleration of the cable suspension point can be set to 0 without significantly deteriorating the model output. Therefore, when a non-linear model is used, the acceleration of the cable suspension point is preferably set to 0.

The observer of the present invention preferably works as follows: It predicts a future state of the system based on the current estimation of the state of the system and inputs, wherein these inputs may comprise a previous sensor input of the first sensor and/or the position of the cable suspension point, and may comprise further data. Further, the observer predicts a future sensor value of the first sensor. The difference between the real measurement and the predicted measurement of the first sensor is then used to correct at least the estimated state.

The model used in the observer may at least comprise a model of the pendulum dynamics of the load suspended on the cable. However, the model may also take into account other effects that might have an influence on the measurement values of the first sensor. For example, the observer may comprise a disturbance model for sensor offset. Thereby, effects of an offset of the sensor can be eliminated. Further, the observer may comprise a disturbance model for string oscillation of the cable. Thereby influences of such oscillations may be reduced. Further, the observer of the present invention may take into account sensor noise and/or process noise.

In a preferred embodiment of the present invention, the physical model of the observer is based on a single pendulum model of the load suspended on the cable. However, for certain applications, where load suspension means with a large mass and/or large distance form the load are used to suspend the load, the observer may also be based on the double pendulum dynamics of the load suspended on the suspension means which are in turn suspended on the cable. For example, the load may be suspended on a traverse by chains and the traverse suspended on the cable. For such purposes, the observer may be based on the double pendulum model.

Preferably, in the present invention, at least one absolute load position and/or absolute load velocity in a coordinate system that is independent of the position of the cable suspension point is used as a state variable. Further, at least the load position and/or load velocity in a radial direction of the crane is used as a state variable. However, in a preferred embodiment, the horizontal load position and/or velocity in two directions is used as a state variable. Further, the vertical load position and/or velocity may be used.

For example, the load position and/or load velocity may be described in Cartesian coordinates. Alternatively, polar coordinates might be used for the load position and/or load velocity. Cartesian coordinates were already used in document DE 10 2009 032 267 A1 for a crane control itself. However, in this document, no observer set-up was described.

In a preferred embodiment of the present invention, the cable angle is not used as a state variable. Thereby, the above described problems are avoided.

Nevertheless, the observer of the present invention may be used with a first sensor that measures the cable angle and/or the cable angle velocity. From these sensor inputs, the observer of the present invention estimates the state vector, this state vector comprising the load position and/or the load velocity. Further, the observer predicts expected measurement values for such a sensor, in order to compare them with the real measurements.

Preferably, the sensor is a gyroscope. Further, the sensor may be located on a cable follower. In particular, such a cable follower may be attached to a boom tip of the crane, in particular by a cardanic joint. The cable follower preferably follows the motion of the cable, such that the sensor attached to the cable follower will follow the motion of the cable, as well.

In a preferred embodiment, the observer of the present invention uses an extended Kalman filter for estimating the load position and/or the load velocity. Such an extended filter comprises a state estimation based on the current state and the inputs. Further, the Kalman filter comprises a covariance estimation for estimating a covariance of the state estimation. Further, the Kalman filter will predict an expected measurement. This expected measurement will be compared with the real measurement in order to correct both the state estimate and the covariance estimate.

Preferably, the Kalman filter uses a time in discretization of the model dynamics. Preferably, a single Newton step is used for this purpose.

The crane control apparatus of the present invention preferably is used in order to control the movement of a crane on the basis of an operator input and/or an automated control system. In particular, the crane control apparatus may be used in order to control the motors of the crane. Further, the crane control apparatus may be used for moving or positioning the load on a desired track or to a desired position. This control is now based on the load position and/or velocity estimated by the observer of the present invention.

Further, the crane control apparatus of the present invention may comprise an anti-sway control for avoiding unwanted pendulum or rotational motion of the load. Preferably, this anti-sway control is based on the estimate of the position and/or velocity of the load provided by the observer of the present invention as state-feedback.

Further, the crane control apparatus of the present invention may comprise a trajectory planning module for planning trajectories of the load suspended on the cable.

The present invention may in particular be used for controlling a crane having a boom having a horizontal luffing axis, around which the boom may be luffed up and down in a vertical plane. For this purpose, for example, a luffing cylinder may be used. Further, the crane may have a vertical slewing axis, around which the boom may be turned. For this purpose, for example, the boom may be attached to a tower that can be rotated around the slewing axis. Further, the cable length may be controlled by a hoisting winch of the crane.

In a preferred embodiment, the cable is directed from the hoisting winch around a cable suspension point located at the tip of the boom to the load.

The crane of the present invention may in particular be a harbour crane and/or a mobile crane. In a preferred embodiment, the crane of the present invention is a mobile harbour crane.

The present invention further comprises a crane control method for a crane where a load is suspended on a crane cable from a suspension point of the crane, wherein an observer is used for estimating at least the position and/or velocity of the load from at least one sensor input by using a physical model of the load suspended on the crane cable, wherein the physical model of the observer uses the load position and/or a load velocity as a state variable.

The method of the present invention has the same advantages as the crane control apparatus described above.

Preferably, the crane control method of the present invention has the features of the preferred embodiments of the crane control apparatus described above. In particular, the crane control method may use a crane control apparatus as described above.

The present invention further comprises a crane control software, in particular a crane control software stored on a computer-readable storage medium, comprising code implementing a crane control apparatus or a crane control method as described above. Such a crane control software may, for example, be used to update an existing crane control apparatus.

Preferably, the crane control apparatus may use a computer which can run the crane control software of the present invention.

Further, the present invention comprises a crane having a crane control apparatus as described above. Further, the crane may be a crane as described above in conjunction with the control apparatus of the present invention.

BRIEF DESCRIPTION OF THE DRAWINGS

The present invention is now described by a way of embodiments and figures. Thereby.

FIG. 1: An embodiment of a crane using a crane control apparatus of the present invention, FIG. 2: a simple crane model explaining the influence of different state definitions, FIG. 3: a diagram showing a pendulum model for a single pendulum observer, FIG. 4: an embodiment of a first sensor mounted on cable followers mounted on the cable of a crane, FIG. 5: a diagram showing the crane movement and the load swing during a luffing sequence, with a rope length of l=48 m, FIG. 6: a comparison between the load velocity estimate of the observer of the present invention and a GPS reference measurement, FIG. 7: an embodiment of a crane with a double pendulum load configuration, FIG. 8: a diagram showing a pendulum model for a double pendulum observer and FIG. 9: a comparison of a hook velocity estimate according to a observer of the present invention and a measured hook velocity by GPS for the double pendulum case, with a hook mass of $m_H$=2.2 t, a load mass of $m_L$=2.5 t, and cable lengths of L1=35 m and L2=5 m.

DESCRIPTION OF THE PREFERRED EMBODIMENTS

Figure 1:
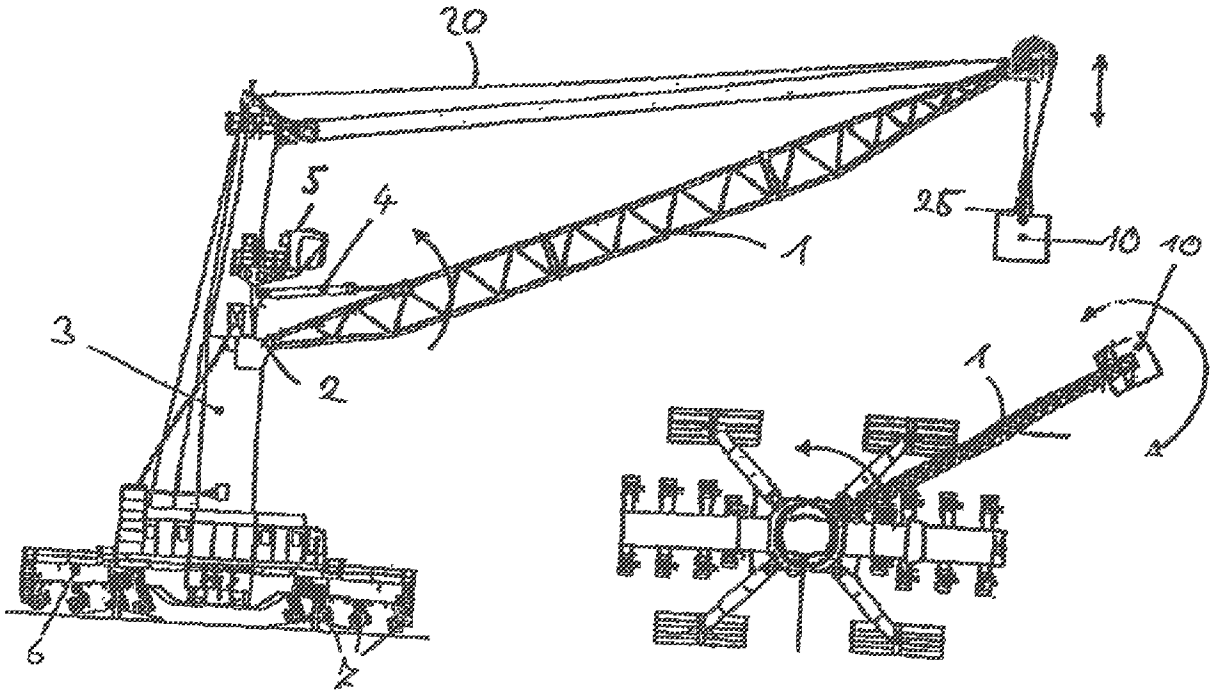
FIGS. 1 to 9 show.

FIG. 1 shows an embodiment of a crane according to the present invention, in particular of a harbour mobile crane as it is used for moving loads in a harbour. The crane may have a load capacity of up to 140 t and a cable or rope length of up to 80 m.

The embodiment of the crane of the present invention comprises a boom 1, which can be luffed up and down around a horizontal luffing axis 2, with which the boom is linked to a tower 3. The tower 3 may be turned around a vertical slewing axis by which the boom 1 is slewed, as well. The tower 3 is further mounted on an undercarriage 6, which is moveable by driving units 7. For slewing the tower 3, a slewing drive that is not shown in the figure is used. For luffing the boom 1, the hydraulic cylinder 4 is used.

The cable or rope 20 to which the load 10 is attached is guided around a pulley arranged at the boom tip, the boom tip therefore forming the cable suspension point for purposes of the present invention. The length of the cable 20 might be controlled by a hoisting winch.

At the end of the cable 20, load suspension means may be arranged, for example a manipulator or a spreader by which the load 10 might be suspended on the cable.

The crane of the present invention may comprise two cable strands that go from the boom tip to the load.

Figure 4:
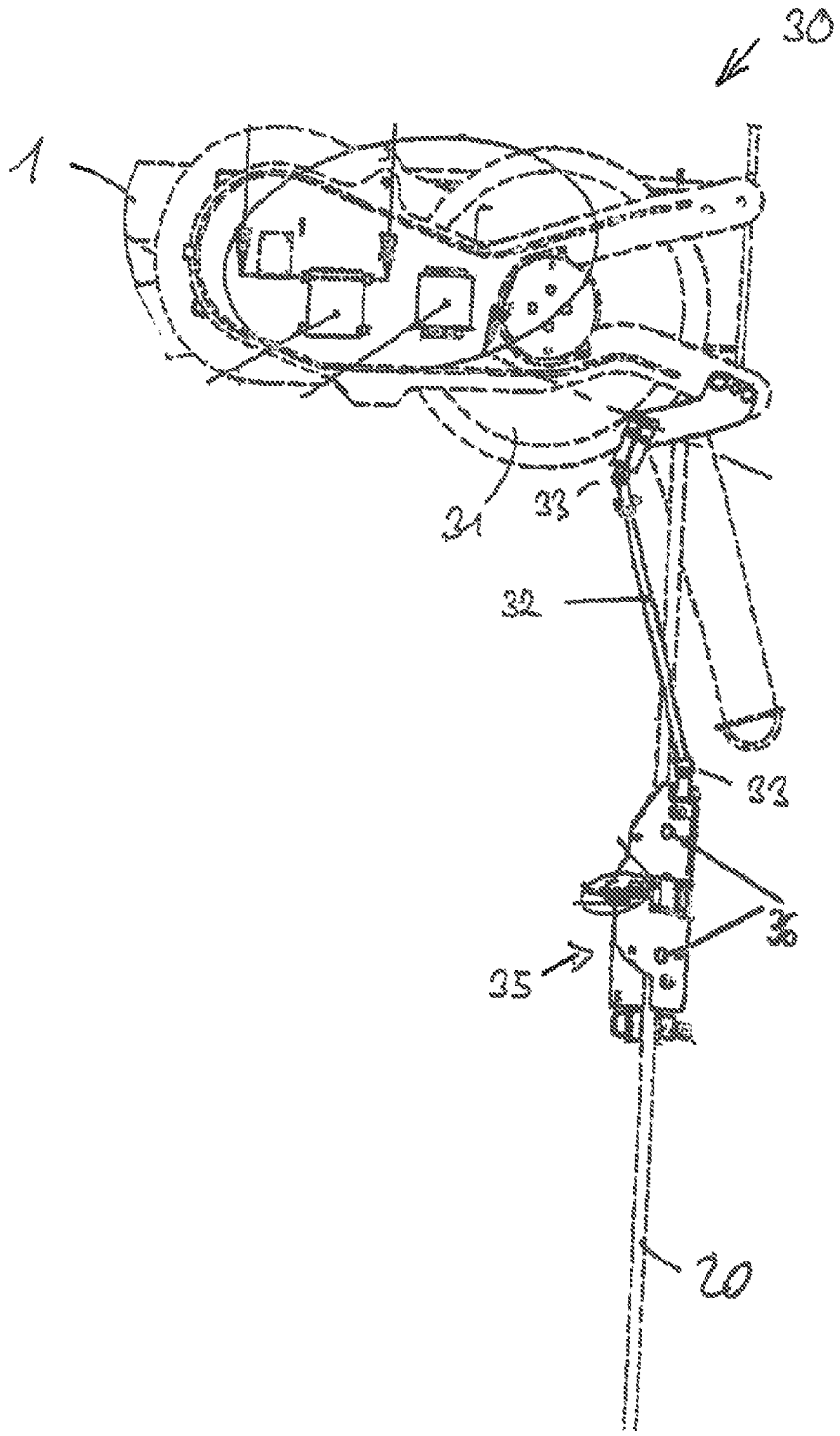

Further, FIG. 4 shows an embodiment of a first sensor that may be used for providing input values for the observer of the present invention. In particular, the first sensor 36 may be mounted on a cable follower 35 for measuring the cable angle and/or the cable velocity. In particular, the sensor 36 might be a gyroscope for measuring the cable velocity. The first sensor may measure the cable angle or cable velocity both in tangential and in radial directions of the crane, for example by using two gyroscopes arranged accordingly.

The cable follower shown in FIG. 4 may be attached to the boom tip 30 of the boom 1 by cardanic links 32 and 33 just under the main cable pulley 31. The cable follower 35 comprises pulleys 36, by which it is guided on the cable 20, such that the cable follower 35 follows the movements of the cable 20. The cardanic links 32 and 33 allow the cable follower to move freely around a horizontal and a vertical axis. However, turning movements of the cable follower are avoided.

The present invention now provides a crane control apparatus for controlling the position and/or velocity of the load suspended on the rope by using feedback control, where the position and/or the velocity of the load is determined based on measurements and used as feedback. The present invention now provides an observer design where an inertial coordinate system is used for modelling the load swing. This eliminates the need of measuring the boom tip acceleration and therefore improves the observer performance during acceleration phases.

The rest of the description is organised as follows:

In Section 2 the coordinate system is introduced. This choice is particularly important for crane observer design since it eliminates the need to measure the suspension point acceleration. The single-pendulum model and the observer are designed in Section 3. Afterwards, Section 4 deals with the double-pendulum model. The performance of both observers is validated using reference measurements.

2. CHOICE OF COORDINATE SYSTEM

Figure 2:
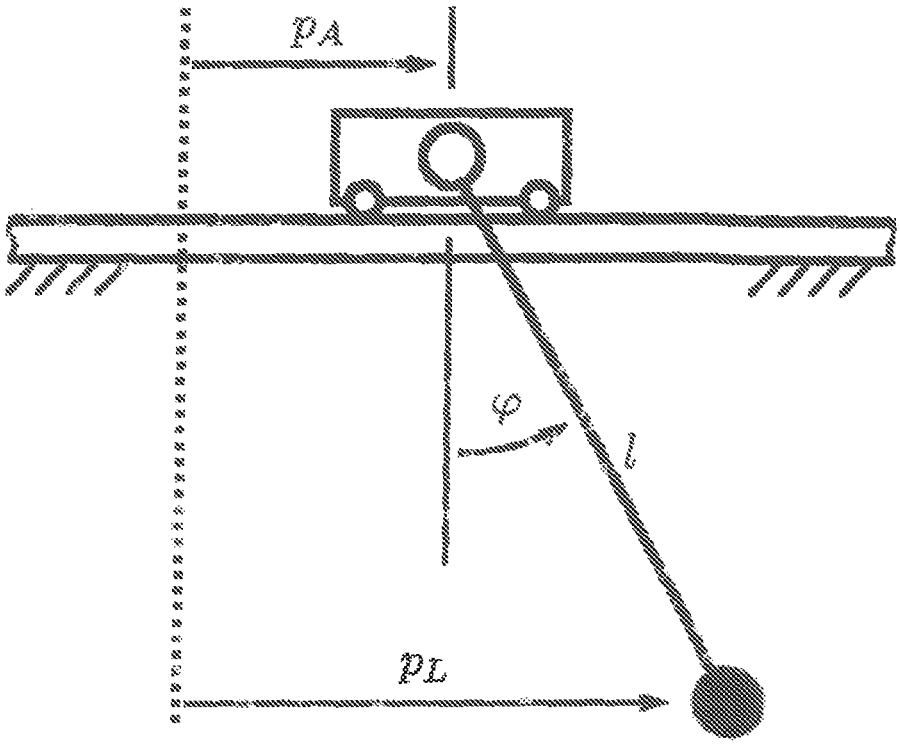

Prior-art systems use the position of the load suspension point and its velocity as state variables, and also the so-called "rope angle" and its derivative. In FIG. 2 these quantities are called $p_A$, $\dot{p}_A$, $\phi$ and $\dot{\phi}$. Assuming the model input u to be the acceleration of the suspension point, l being the rope length and g the gravitational acceleration, the linearized dynamic model will be:

$$\ddot{p}_A = u, \tag{1a}$$

$$\ddot{\varphi} = -\frac{g}{l}\varphi - \frac{1}{l}u. \tag{1b}$$

Eqn. (1b) is a differential equation describing the load sway. It can be seen that the pendulum is excited by the acceleration u of the suspension point. In this invention a different choice of the state vector is used for crane modeling. Introducing the horizontal load position $p_L=p_A+l\phi$ and its derivative $\dot{p}_L=\dot{p}_A+l\dot{\phi}$ as states, the dynamic model (1) can be restated as:

$$\ddot{p}_A = u, \tag{2a}$$

$$\ddot{p}_L = -\frac{g}{l}(p_L - p_A). \tag{2b}$$

The dynamics of (1) and (2) are identical. There is still an important difference when it comes to observer design between (1b) and (2b): Eqn. (2b) does not depend on the acceleration u but on the suspension point position $p_A$.

In industrial implementations, the suspension point position $p_A$ is usually measurable with high accuracy. However, the suspension point acceleration u is not that easy to quantify. Differentiation methods get quite involved when it comes to differentiating twice. Actuator models which reconstruct the acceleration u from valve currents and friction models also carry large uncertainties. Being aware of this finding, the load position $p_L$ is used as a state variable in this invention.

3. SINGLE-PENDULUM OBSERVER

The goal of this section is to design a single-pendulum observer. Contrary to the preliminary examination in Section 2, the full nonlinear model of the main pendulum dynamics is presented in Subsection 3.1. After the measurement equation is determined (Subsection 3.2), an Extended Kalman Filter is composed (Subsection 3.3) and finally experimental results are shown (Subsection 3.4). For simplicity, all calculations are presented only for the planar (two-dimensional) case.

3.1 Pendulum Modeling

In crane control systems, it is generally assumed that the rope is massless and that the load can be modeled as a point mass. This leads to the "single-pendulum" model of a crane.

Figure 3:
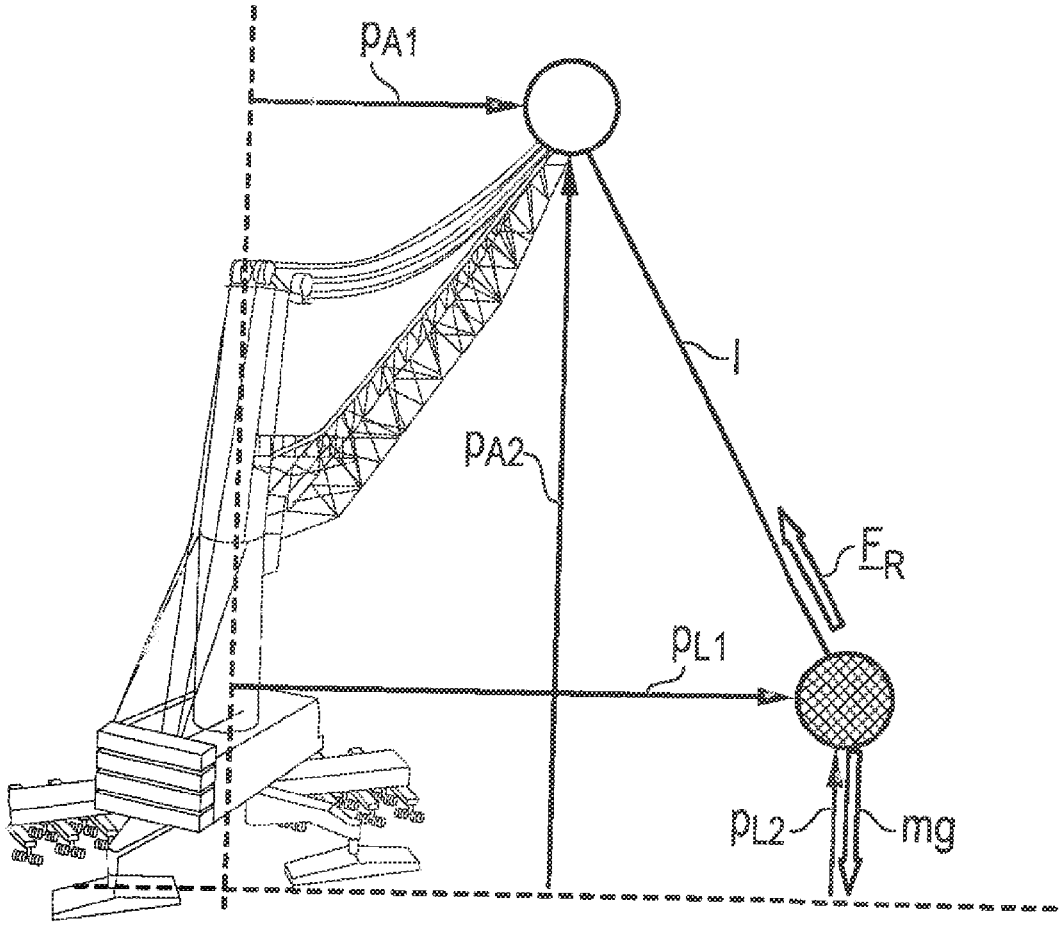

The position of the boom tip $\underline{p}_L=(p_{L1},p_{L2})^T$ and its time derivatives are assumed to be known. The same holds for the rope length l. With these inputs, the dynamics of the load position $\underline{p}_L=(p_{L1},p_{L2})^T$ can be set up using the Newton-Euler-method (see FIG. 3). As a generalized coordinate q the horizontal load position $q=p_{L1}$ is used. The overall load position p can be expressed in terms of this generalized coordinate:

$$\underline{p}_L=\begin{pmatrix} q \\ p_{A2}-\sqrt{l^2-(q-p_{A1})^2} \end{pmatrix}. \tag{3}$$

The load velocity $\dot{\underline{p}}_L$ can be written as:

$$\dot{\underline{p}}_L=\frac{\partial \underline{p}_L}{\partial q}\dot{q}+\frac{\partial \underline{p}_L}{\partial t}=\underline{J}\dot{q}+\underline{\nu} \tag{4}$$

with the abbreviations:

$$\underline{J}=\frac{\partial \underline{p}_L}{\partial q}=\begin{pmatrix} 1 \\ \dfrac{q-p_{A1}}{\sqrt{l^2-(q-p_{A1})^2}} \end{pmatrix}, \tag{5}$$

$$\underline{\nu}=\frac{\partial \underline{p}_L}{\partial t}=\begin{pmatrix} \dot{p}_{A2}-\dfrac{\dot{l}l+(q-p_{A1})\dot{p}_{A1}}{\sqrt{l^2-(q-p_{A1})^2}} \end{pmatrix}. \tag{6}$$

Similarly, the load acceleration can be expressed as:

$$\ddot{p}_L=\underline{J}\ddot{q}+\frac{\partial \underline{J}}{\partial t}\dot{q}+\frac{\partial \underline{J}}{\partial q}\dot{q}^2+\frac{\partial \underline{\nu}}{\partial t}+\frac{\partial \underline{\nu}}{\partial q}\dot{q}, \tag{7}$$

where $$\frac{\partial J}{\partial t},\ \frac{\partial J}{\partial q},\ \frac{\partial \underline{\nu}}{\partial t}\ \text{and}\ \frac{\partial \underline{\nu}}{\partial q}$$

where can be calculated from Eqs. (5) and (6). Newton's second law for the load mass is:

$$m\ddot{\underline{p}}_L=\begin{pmatrix} 0 \\ -mg \end{pmatrix}+F_R, \tag{8}$$

with the load mass m, the gravitational acceleration g and the rope force vector $\underline{F}_R$. With (7) plugged in and the rope force $\underline{F}_R$ being eliminated using D'Alembert's principle, the pendulum dynamics are:

$$(\underline{J}^T\underline{J})\ddot{q}=\underline{J}^T\left[\begin{pmatrix} 0 \\ -g \end{pmatrix}-\frac{\partial \underline{J}}{\partial t}\dot{q}-\frac{\partial \underline{J}}{\partial q}\dot{q}^2-\frac{\partial \underline{\nu}}{\partial t}-\frac{\partial \underline{\nu}}{\partial q}\dot{q}\right], \tag{9}$$

which can be considered as a differential equation:

$$\ddot{q}=f_q(q,\dot{q},\underline{u}). \tag{10}$$

The model inputs u are the position, velocity, and acceleration of the boom tip as well as the rope length and its time derivatives. All these quantities are needed to evaluate $\underline{J}$ and $\dot{\underline{\nu}}$ and the derivatives of these terms in Eqn. (9)[2]:

[2] The position and velocity of the boom tip can be measured using incremental encoders. Unfortunately those signals were too noisy for finding the accelerations $\ddot{p}_{A1}$, $\ddot{p}_{A2}$, and $\ddot{l}$. However, experiments have shown that these accelerations do not influence the filtering results much. Since the analysis in Section 2 revealed that the linearized model does not depend on the accelerations at all, this observation is not unexpected. Therefore $\ddot{p}_{A1}\approx\ddot{p}_{A2}\approx 0$ can be assumed.

$$\underline{u}=(p_{A1},p_{A2},\dot{p}_{A1},\dot{p}_{A2},\ddot{p}_{A1},\ddot{p}_{A2},l,\dot{l},\ddot{l}). \tag{11}$$

A reasonable initial condition for this model is to assume the load to be vertically below the boom tip, $q(0)=p_{A1}$, having no load swing, $\dot{q}(0)=\dot{p}_{A1}$.

3.2 Expected Measurement Signal

The gyroscopes are attached to the rope near the tip of the boom (see FIG. 4). In general, gyroscopes measure the rotation rate of the device in its own body-fixed coordinate system. However, since only a planar problem setup is considered, the body-fixed rotation rate is the same as the inertial rotation rate. Therefore the rotation rate $\omega_{hope}$ is simply the time-derivative of the rope angle $\phi$ (cf. FIG. 2). The rope angle can be expressed as:

$$\varphi=\arcsin\left(\frac{q-p_{A1}}{l}\right). \tag{12}$$

Assuming changes in the rope length to be negligible, $\dot{l}\approx 0$, the ideal measurement signal is therefore:

$$\omega_{rope}=\frac{d\varphi}{dt}=\frac{\dot{q}-\dot{p}_{A1}}{\sqrt{l^2-(q-p_{A1})^2}}. \tag{13}$$

Real gyroscope measurements include a number of disturbances. In this case the major gyroscope error is a simple (mainly temperature-dependent) signal offset. This offset is a common problem of MEMS sensors, but since changes in the sensor offset are much slower than the pendulum dynamics, they cause no problems. A simple offset disturbance model is:

$$\dot{\omega}_{offset}=0. \tag{14}$$

An important measured disturbance are the higher-order string oscillations. Especially for long ropes and low load masses, crane ropes resonate just like guitar strings. These oscillations are also easily be dealt with. The first two harmonic frequencies of a vibrating string are $$f_1=\frac{1}{2l}\sqrt{\frac{F_R}{\mu}}\ \text{and}\ f_2=\frac{1}{l}\sqrt{\frac{F_R}{\mu}}, \tag{15}$$

where l is the rope length, $F_R$ the rope force and $\mu$ the mass per meter of the rope. Higher-order harmonic frequencies could be calculated in the same way, however, they are not yet dominant at the rope lengths under consideration. Since these string oscillations are quite sinusoidal, a simple disturbance model is:

$$\ddot{\omega}_{harmonic,1}=-2\pi f_1\omega_{harmonic,1}, \tag{16}$$

$$\ddot{\omega}_{harmonic,2}=-2\pi f_2\omega_{harmonic,2}. \tag{17}$$

Another well-known pendulum disturbance is wind. However, experience shows that even for large containers, wind forces are not challenging for crane control. Therefore this model provides no wind disturbance compensation even though the LHM cranes are equipped with wind sensors.

The presented crane model is observable as long as the frequencies of the different oscillators do not match. In case of the LHM cranes, the weight of the hook itself guarantees that the harmonic frequencies are considerably higher than the main pendulum oscillation frequency even for short rope lengths.

3.3 Observer Setup

An Extended Kalman Filter requires the observer problem to be stated in the form:

$$\dot{x}(t_k)=\underline{f}(\underline{\hat{x}}(t_{k-1}),\underline{u}(t_{k-1})),\underline{\hat{x}}(t_0)=\underline{\hat{x}}_0, \tag{18}$$

$$\hat{y}(t_k)=h(\underline{\hat{x}}(t_k),\underline{u}(t_k)), \tag{19}$$

where $\underline{\hat{x}}$ is the estimated state vector, $\underline{u}$ the model input and $\hat{y}$ the expected measurement. Here, the state vector combines the pendulum dynamics (9) and the disturbance model dynamics (14), (16), and (17):

$$\underline{\hat{x}}=(q,\dot{q},\omega_{offset},\omega_{harmonic,1},\dot{\omega}_{harmonic,1},\omega_{harmonic,2},\dot{\omega}_{harmonic,2}). \tag{20}$$

Eq. (18) is in time-discrete form while (10), (14), (16), and (17) were given in continuous-time form. Therefore, they have to be discretized. The disturbance models (14), (16), and (17) are linear with time-invariant parameters[3], and can therefore be discretized analytically. For discretizing the nonlinear pendulum dynamics (10) however, an integration scheme is needed. This integration scheme has to be stable when applied to undamped oscillators. A modified one-step Rosenbrock formula is found to comply with these requirements. It is implicit, therefore a series of Newton iterations can be used to calculate the solution. It turned out that a single Newton step is enough to generate a stable pendulum motion prediction even without observer feedback[4]. Therefore the pendulum state prediction $\underline{\hat{x}}_{12}(t_k)$ can be found by solving the system of linear equations:

[3] Changes in the harmonic frequencies f1 and f2 occur slowly and can therefore be neglected.

[4] Another advantage of doing only a single Newton step is that the required Jacobian is also needed for the EKF covariance prediction. That means that the first Newton step can be done at almost no additional computational costs.

$$\left[I-0.5h\cdot\left.\frac{\partial \underline{f}_q}{\partial \underline{\hat{x}}_{12}}\right|_{t_{k-1}}\right]\cdot[\underline{\hat{x}}_{12}(t_k)-\underline{\hat{x}}_{12}(t_{k-1})]=h\cdot\underline{f}_q|_{t_{k-1}}, \tag{21}$$

where $h=t_k-t_{k-1}$ is the discretization time, $\underline{f}_q$ are the continuous-time pendulum dynamics, and $\underline{\hat{x}}_{12}(t_k)=[q(t_k),\dot{q}(t_k)]$ denotes the first two elements of $\underline{\hat{x}}(t_k)$. The output equation (19) does not require discretization. It combines the ideal measurement signal (13) with the disturbance signal models (14), (16), and (17):

$$\hat{y}=h(\underline{\hat{x}},\underline{u})=\omega_{rope}=\omega_{offset}=\omega_{harmonic,1}+\omega_{harmonic,2}. \tag{22}$$

With the system model in the form (18), (19), the well-known EKF prediction-correction filtering method can be applied repeatedly. When the algorithm is called at time tk, the old state estimate $\underline{\hat{x}}(t_{k-1})$ is taken and its propagation over the discretization time h is simulated. At the same time, the system matrix of the linearized model $$A(t_{k-1})=\left.\frac{\partial \underline{f}}{\partial \underline{\hat{x}}}\right|_{t_{k-1}}$$

is used to predict the covariance of the state estimation. The predicted state and the associated covariance are called $\underline{\hat{x}}^-(t_k)$ and $P^-(t_k)$:

$$\underline{\hat{x}}^-(t_k)=\underline{f}(\underline{\hat{x}}(t_{k-1}),\underline{u}(t_{k-1})),$$

$$P^-(t_k)=A(t_{k-1})\cdot P(t_{k-1})\cdot A(t_{k-1})^T+h/2(Q+A(t_{k-1})\cdot Q\cdot A(t_{k-1})^T). \tag{24}$$

The predicted estimation covariance $P^-(t_k)$ and the linearization of the output equation $$H(t_{k-1})=\left.\frac{\partial h}{\partial \underline{\hat{x}}}\right|_{t_k}$$

are used to calculate the Kalman gain $K(t_k)$:

$$K(t_k)\cdot[H(t_k)\cdot P^-(t_k)\cdot H^T(t_k)+R]=P^-(t_k)\cdot H^T(t_k) \tag{25}$$

Then the difference of the real measurement y to the predicted measurement $\hat{y}$ at time $t_k$ is used to correct both the state and the covariance estimate:

$$\underline{\hat{x}}(t_k)=\underline{\hat{x}}^-(t_k)+K(t_k)\cdot(y(t_k)-\hat{y}(t_k)), \tag{26}$$

$$P(t_k)=P^-(t_k)-K(t_k)\cdot H(t_k)\cdot H(t_k)\cdot P^-(t_k). \tag{27}$$

The parameters used for this algorithm on the Liebherr LHM crane are given in Table 1. Please note that only the diagonal elements of the process noise matrix Q were set. Therefore, only those are given in Table 1.

TABLE 1

Parameters and Ranges

| Symbol | Name | Value |
|---|---|---|
| l | Rope length | 5-120 m |
| g | Gravitational acceleration | 9.81 m/s$^2$ |
| PA1, PA2 | Boom Workspace | 10-48 m |
| $F_R$ | Rope force | 9-1020 kN |
| μ | Rope weight | 9 kg/m |
| R | Sensor noise | $2\cdot10^{-5}$ rad$^2$/s$^2$ |
| $Q_q$ | Process noise | 0.2 m$^3$/s$^2$ |
| $Q_{\dot{q}}$ | | 2 m$^2$/s$^4$ |
| $Q\omega_{offset}$ | | $2\cdot10^{-5}$ rad$^2$/s$^4$ |
| $Q\omega_{harmonic}$ | | 1 rad$^2$/s$^4$ |
| $Q\dot{\omega}_{harmonic}$ | | $1\cdot10^{-4}$ rad$^2$/s$^4$ |
| h | Discretization time | 0.025 s |

3.4 Results

Figure 5:
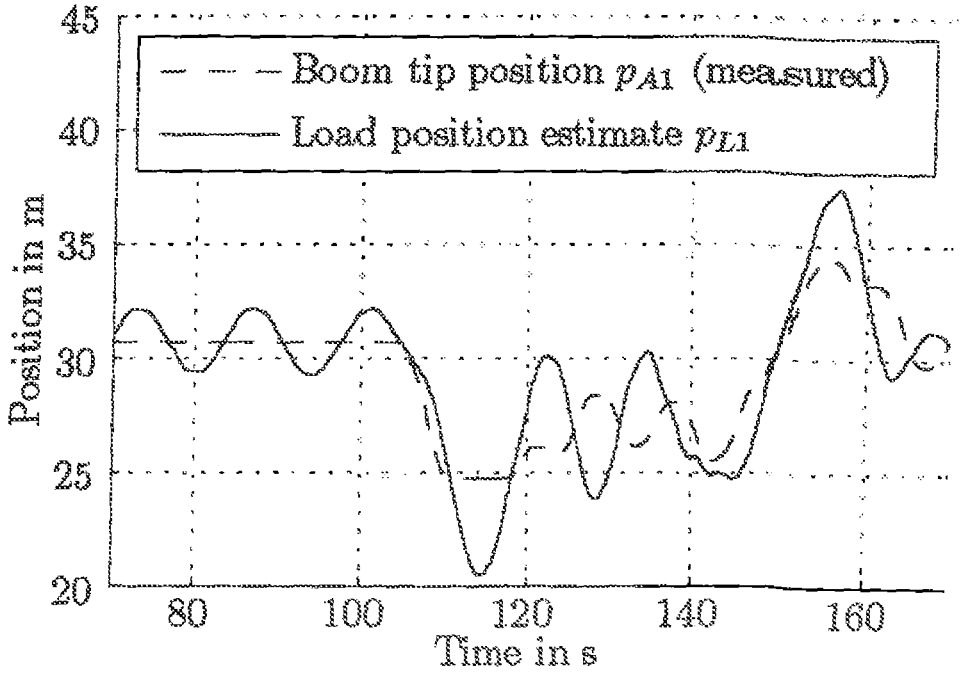
Figure 6:
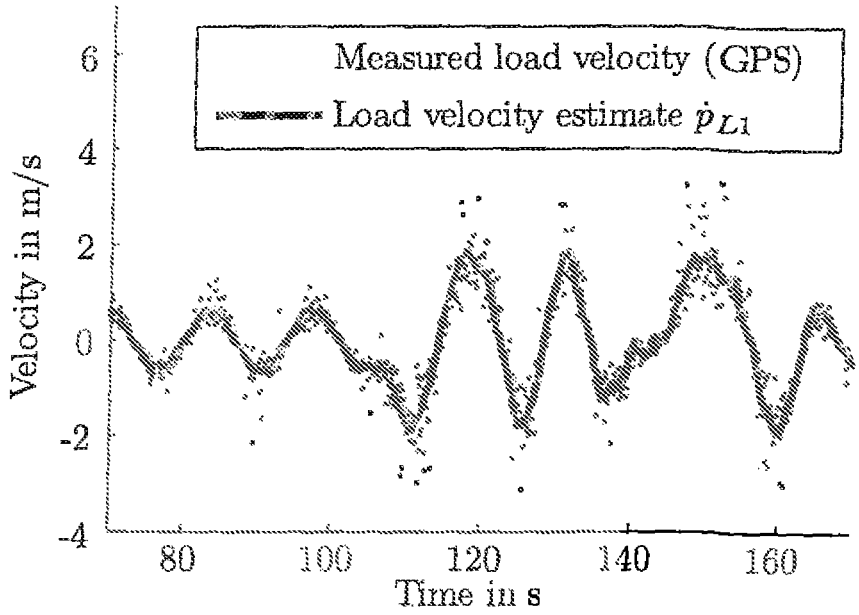

FIG. 5 shows the position of the boom tip during a luffing sequence as well as the observed load position. It can be seen that the load is always accelerated towards the boom tip. For the same luffing sequence, FIG. 6 compares the load velocity estimation from the presented observer with GPS reference measurements. Those reference measurements were recorded with a Novatel RT-2 receiver with RealTime-Kinematic capabilities (RTK-GPS)[5,6]. It can be seen that the observed state estimation is in good accordance with the GPS reference measurements.

[5] The antenna was placed on the load and therefore measured the horizontal load position pL1 (and not the plotted velocity p'L1). However, there was a systematic bias in the GPS position measurements compared to the observer. The reason for this offset was a small, unmodeled crane tower deflection which depends on the crane load. Therefore the GPS position measurements were differentiated and the resulting GPS load velocity was used as a reference for the observer's load velocity estimation.

[6] It must be noted that the RTK-GPS system is adequate for experimental reference measurement only. In real crane applications the hook can easily be surrounded by containers or might be lowered into the ship's hull where the GPS antenna has no reception.

4. DOUBLE-PENDULUM OBSERVER

Figure 7:
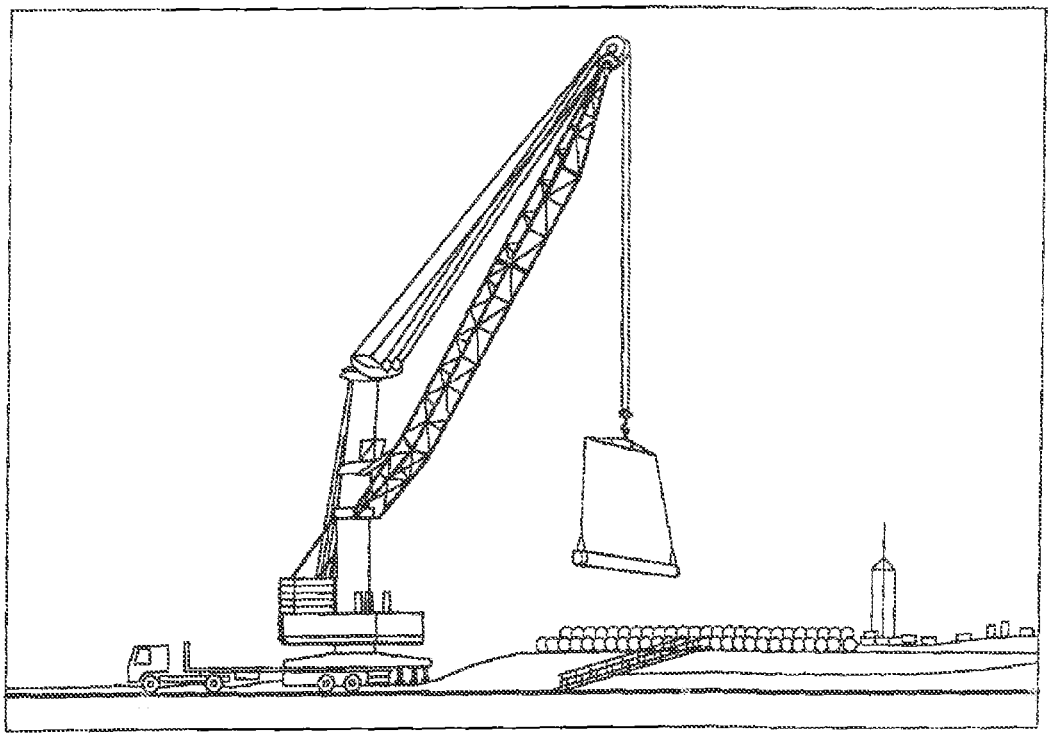

When handling general cargo, double-pendulum configurations as seen in FIG. 7 are common. In this section the crane model is therefore extended to a double-pendulum configuration.

4.1 Double-Pendulum Modelling

Figure 8:
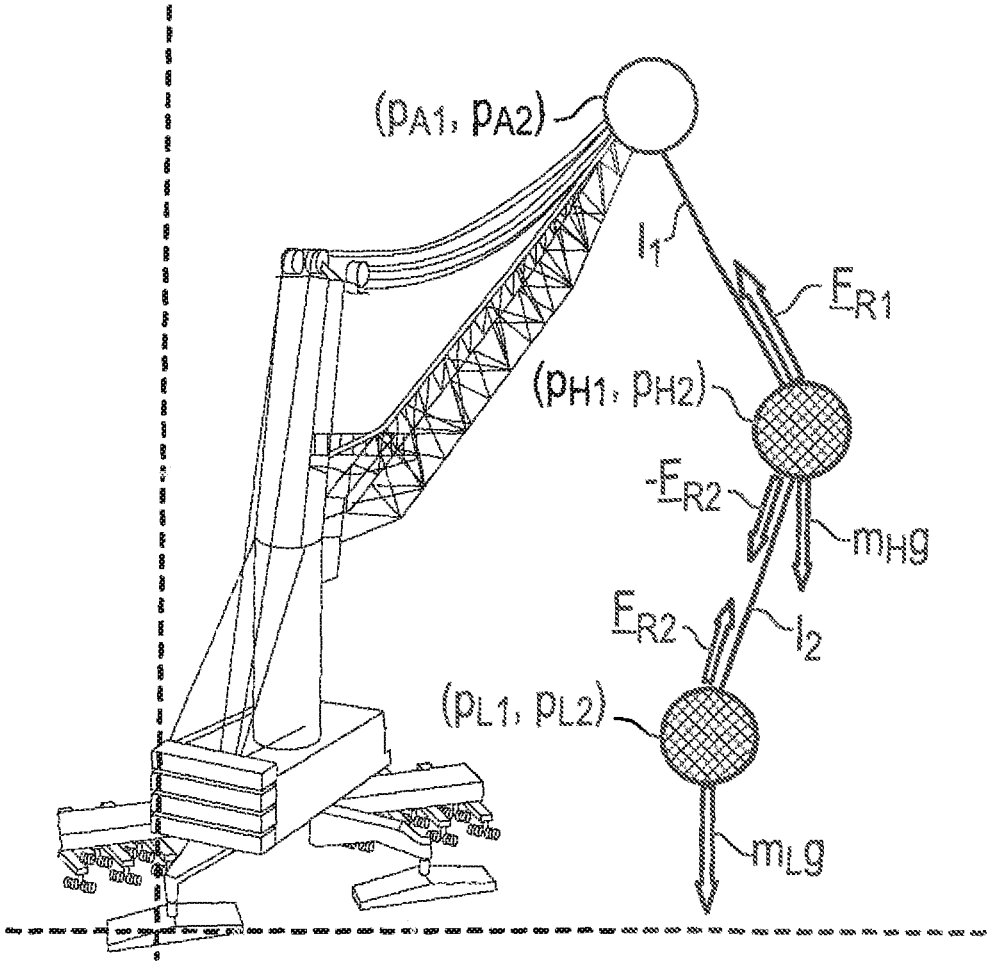

The modeling of the double-pendulum is essentially analogous to Section 3.1. The length of the rope between boom tip and hook is $l_1$ and the rope length between hook and load is $l_2$. Unlike $l_1$, the distance between the hook and the load cannot change. Therefore $l_2$ is considered constant. As shown in FIG. 8, the hook and load are modelled as point masses with the positions $\underline{p}_H=(p_{H1},p_{H2})^T$ and $\underline{p}_L=(p_{L1},p_{L2})^T$. In order to shorten the calculations, both positions can be written in a single vector:

$$\underline{p}=(p_{H1},p_{H2},p_{L1},p_{L2})^T. \tag{28}$$

Using the horizontal coordinates of the hook and of the load as generalized coordinates, $q_1=p_{H1}$ and $q_2=p_{L1}$, the position vector can be expressed as follows (see FIG. 8):

$$\underline{p}=\begin{pmatrix} q_1 \\ p_{A2}-s_1 \\ q_2 \\ p_{A2}-s_1-s_2 \end{pmatrix}, \tag{29}$$

where $s_1$ and $s_2$ are:

$$s_1=\sqrt{l_1^2-(q_1-p_{A1})^2},\ s_2=\sqrt{l_2^2-(q_2-q_1)^2}. \tag{30}$$

Even though the dimension of the problem has changed, the expressions for the velocity and acceleration are nearly the same as for the single-pendulum in (4) and (7):

$$\dot{\underline{p}}=\frac{\partial \underline{p}}{\partial \underline{q}}\dot{\underline{q}}+\frac{\partial \underline{p}}{\partial t}=J\dot{\underline{q}}+\underline{v}, \tag{31}$$

$$\ddot{\underline{p}}=J\ddot{\underline{q}}+\left(\frac{\partial J}{\partial t}+\frac{\partial J}{\partial q_1}\dot{q}_1+\frac{\partial J}{\partial q_2}\dot{q}_2\right)\dot{\underline{q}}+\frac{\partial \underline{v}}{\partial t}+\frac{\partial \underline{v}}{\partial \underline{q}}\dot{\underline{q}}. \tag{32}$$

Applying Newton's second law to the point masses gives:

$$M\ddot{\underline{p}}=\begin{pmatrix} 0 \\ -m_H g \\ 0 \\ -m_L g \end{pmatrix}+\begin{pmatrix} \underline{F}_{R1}-\underline{F}_{R2} \\ \underline{F}_{R2} \end{pmatrix}, \tag{33}$$

where $\underline{F}_{R1}$ and $\underline{F}_{R2}$ are the rope force vectors and M is the mass matrix: $M=\mathrm{diag}(M_H, M_H, M_L, M_L)$. With (32) plugged into (33) and D'Alembert's principle being applied, the following double-pendulum dynamics can be obtained:

$$(J^T MJ)\ddot{\underline{q}}=J^T M\left[\begin{pmatrix} 0 \\ -g \\ 0 \\ -g \end{pmatrix}-\left(\frac{\partial J}{\partial t}+\frac{\partial J}{\partial q_1}\dot{q}_1+\frac{\partial J}{\partial q_2}\dot{q}_2\right)\dot{\underline{q}}-\frac{\partial \underline{v}}{\partial t}-\frac{\partial \underline{v}}{\partial \underline{q}}\dot{\underline{q}}\right]. \tag{34}$$

The structure of the differential equation $\ddot{\underline{q}}=f_{\underline{q}}(\underline{q},\dot{\underline{q}},\underline{u})$ as well as the inputs $\underline{u}$ have not changed compared to the single-pendulum case. Also, the measurement equation has not changed compared to (13), except for the variable names:

$$\omega_{rope}=\frac{\dot{q}_1-\dot{p}_{A1}}{\sqrt{l_1^2-(q_1-p_{A1})^2}}. \tag{35}$$

Therefore the Extended Kalman Filter is implemented in the same way as in the single-pendulum case.

It has to be noted that it is possible to lose observability if one of the natural harmonic oscillation frequencies (15) matches the second eigenfrequency of the double pendulum. In case of the LHM cranes, this can only happen at long rope lengths ($l_1$>80 m) and light loads ($m_2$<2000 kg). An additional sensor system in the hook could be used to distinguish between harmonic oscillations and double-pendulum dynamics.

4.2 Results

Figure 9:
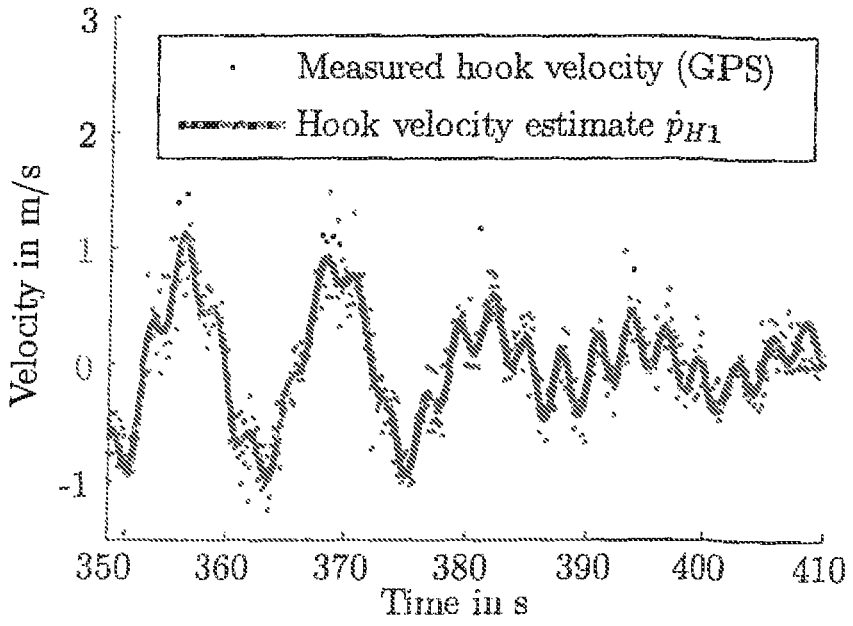

To validate the results of the double-pendulum observer, an RTK-GPS system was installed on the crane; the antenna was put on the hook. FIG. 9 shows both the observed load velocity and the velocity measured via GPS. Until about 380 s in the measurement, both eigenfrequencies of the double-pendulum can be seen. Afterwards the primary oscillation is attenuated by the crane operator, leaving only the second eigenmode oscillating. It can be seen that the observed load velocity matches the reference measurement very well.

5. CONCLUSION

A load position observer was presented for both a single-pendulum and a double-pendulum crane configuration. The observers are implemented as Extended Kalman Filters. The required input signals are the boom tip position which can be measured using incremental encoders and the angular rope velocity, measured by gyroscopes. Natural harmonic oscillations of a crane rope as well as a gyroscope sensor offset were taken into account. The presented observers were tested on Liebherr Harbour Mobile cranes. In an experimental setup, an RTK-GPS system was used to measure the hook position for reference. The RTK-GPS measurements have shown that the observer works as expected both in the single pendulum and in the double pendulum case.

The invention claimed is:

1. A crane control apparatus for a crane where a load is suspended on a crane cable from a cable suspension point of the crane, comprising an observer for estimating at least one of the current position and velocity of the load from at least one sensor input of a first sensor by using a physical model of the load suspended on the crane cable, wherein the physical model of the observer uses at least one of the load position and the load velocity as a state variable and does not use the cable angle and derivatives as state variables, said observer thereby being independent of acceleration of the cable suspension point as a state variable.

2. The crane control according to claim 1, wherein at least one of the observer uses the position of the cable suspension point as an input and the physical model of the observer describes the dynamics of at least one of the load position and the load velocity in dependency on the position of the cable suspension point using a model of the pendulum dynamics of the load suspended on the cable.

3. The crane control apparatus according to claim 2, wherein the position of the cable suspension point is calculated from at least one sensor input of at least one of a second sensor and from control signals for the actuators controlling the position of the cable suspension point.

4. The crane control apparatus according to claim 1, wherein at least one of the physical model is a non-linear model, and the observer uses the velocity of the cable suspension point as an input.

5. The crane control apparatus according to claim 1, wherein the observer is independent of the acceleration of the cable suspension point.

6. The crane control apparatus according to claim 1, wherein the observer comprises a disturbance model for at least one of sensor offset and string oscillations of the cable for predicting measurement values of the first sensor.

7. The crane control apparatus according to claim 1, wherein the physical model of the observer is based on double-pendulum dynamics of the load suspended on suspension means suspended on the cable.

8. The crane control apparatus according to claim 1, wherein at least one of at least one of an absolute load position and an absolute load velocity in a coordinate system that is independent of the position of the cable suspension point is used as a state variable, and the cable angle is not used as a state variable.

9. The crane control apparatus according to claim 1, wherein the first sensor measures at least one of the cable angle and the cable angle velocity, and the sensor is preferably at least one of a gyroscope and located on a cable follower, in particular a cable follower attached to a boom tip of the crane by a cardanic joint.

10. The crane control apparatus according to claim 1, wherein the observer uses an extended Kalman filter for estimating at least one of the load position and the load velocity.

11. The crane control apparatus according to claim 1, comprising at least one of an anti-sway control for avoiding unwanted pendulum or rotational motion of the load and a trajectory planning module for planning trajectories of the load suspended on the cable, wherein preferably at least one of the anti-sway control and the trajectory planning module is based on the estimate of at least one of the position and the velocity of the load provided by the observer.

12. The crane control apparatus according to claim 1, for a crane having at least one of a boom having at least one of a horizontal luffing axis and a vertical slewing axis, and the cable length can be controlled using a hoisting winch, wherein preferably the cable is directed from the hoisting winch around a cable suspension point located at the tip of the boom.

13. A crane comprising a crane control apparatus according to claim 1.

14. The crane control apparatus according to claim 1, wherein the observer is configured to predict future state based on current estimation of only at least one of the load position and the load velocity as the state variable.

15. The crane control apparatus according to claim 1, wherein the observer is configured to predict future state by omitting measurement of acceleration of a tip of a boom of the crane.

16. A control method for a crane where a load is suspended on a crane cable from a suspension point of the crane, comprising the steps of using an observer for estimating at least one of the current position and velocity of the load from at least one sensor input by using a physical model of the load suspended on the crane cable, and using as the physical model of the observer, at least one of the load position and the load velocity as a state variable and omitting using the cable angle and derivatives as state variables, such that the observer is independent of acceleration of the cable suspension point as a state variable.

17. A crane control software, in particular a crane control software on a non-transitory computer-readable storage medium, comprising code implementing the crane control apparatus according to claim 1.

* * * * *